US006918499B2

(12) United States Patent
De Land et al.

(10) Patent No.: US 6,918,499 B2
(45) **Date of Patent: *Jul. 19, 2005**

(54) ADJUSTABLE SHELVING/DISPLAY SYSTEM

(75) Inventors: Martin L. De Land, Corona, CA (US); D. Mark Pritchard, Gurnee, IL (US); Steven C. Thompson, Elkhart, IN (US)

(73) Assignee: L&P Property Management Company, South Gate, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/674,172

(22) Filed: Sep. 29, 2003

(65) Prior Publication Data

US 2004/0055514 A1 Mar. 25, 2004

Related U.S. Application Data

(60) Division of application No. 09/812,758, filed on Mar. 20, 2001, now Pat. No. 6,659,295, which is a continuation-in-part of application No. 09/534,925, filed on Mar. 23, 2000, now Pat. No. 6,520,355.

(60) Provisional application No. 60/126,457, filed on Mar. 26, 1999.

(51) Int. Cl.[7] ..... A47F 5/00

(52) U.S. Cl. ..... 211/187; 211/103; 211/90.02

(58) Field of Search ..... 211/187, 94.01, 211/184, 186, 103, 90.02

(56) References Cited

U.S. PATENT DOCUMENTS

| | | | |
|---|---|---|---|
| 2,154,570 | A | 4/1939 | Holmstrom |
| 2,885,091 | A | 5/1959 | Van Pelt |
| 2,965,242 | A | 12/1960 | Grotke |
| 2,991,889 | A | 7/1961 | Levy et al. |
| 3,160,281 | A | 12/1964 | Ruhnke |
| 3,174,592 | A | 3/1965 | Berman et al. |
| 3,285,424 | A | 11/1966 | Emery |
| 3,471,978 | A | 10/1969 | Fenwick |
| 3,502,292 | A | 3/1970 | Yoder |
| 3,730,108 | A | 5/1973 | Stroh |
| 3,750,893 | A | 8/1973 | Kempler |
| 3,834,093 | A | 9/1974 | Tacke et al. |
| 3,868,021 | A | 2/1975 | Heinrich |
| 3,883,004 | A | 5/1975 | Slaga |
| 3,938,666 | A | 2/1976 | Castleberry |
| 3,971,477 | A | 7/1976 | Bruderly et al. |
| 4,046,083 | A | 9/1977 | Murdoch et al. |
| 4,068,855 | A | 1/1978 | Hackett |
| 4,108,085 | A | 8/1978 | Shepherd et al. |
| 4,127,196 | A | 11/1978 | Boucher |
| 4,138,019 | A | 2/1979 | Smith |
| 4,159,774 | A | 7/1979 | Young, Jr. |
| 4,159,775 | A | 7/1979 | Young, Jr. |
| 4,160,506 | A | 7/1979 | Young, Jr. |
| 4,199,069 | A | 4/1980 | Talarico |
| 4,561,550 | A | 12/1985 | Franklin |
| 4,595,105 | A | 6/1986 | Gold |
| 4,631,881 | A | 12/1986 | Charman |
| 4,693,383 | A | 9/1987 | Fenwick |
| 4,744,475 | A | 5/1988 | St. Pierre |
| 4,829,977 | A | 5/1989 | Valentine |
| 4,887,783 | A | 12/1989 | Franklin |
| 4,917,442 | A | 4/1990 | Johnson |
| 4,919,282 | A | 4/1990 | Duff et al. |
| 4,991,368 | A | 2/1991 | Amstutz |
| 5,027,570 | A | 7/1991 | Mitchell et al. |

(Continued)

*Primary Examiner*—Robert W. Gibson, Jr.
(74) *Attorney, Agent, or Firm*—Michael Best & Friedrich LLP

(57) ABSTRACT

A shelving display system comprising a conventional gondola made up of a generally horizontal base and at least two upstanding posts to which generally horizontal top and bottom tracks are attached. Support/display members, such as decorative panels, standards for shelf brackets and shelves, and partitions may be attached to the top and bottom tracks to complete the system.

16 Claims, 19 Drawing Sheets

U.S. PATENT DOCUMENTS 5,110,080 A 5/1992 Rieman
5,127,341 A 7/1992 Wiklund
5,255,803 A 10/1993 Pavone et al.
5,277,005 A 1/1994 Hellwig et al.
5,305,898 A 4/1994 Merl
5,309,686 A 5/1994 Underwood et al.
5,337,585 A 8/1994 Sandoz et al.
5,372,262 A 12/1994 Benson et al.
5,407,262 A 4/1995 Christian et al.
5,427,255 A 6/1995 Nook
5,439,123 A 8/1995 Nook
5,472,103 A 12/1995 Merl
5,477,971 A 12/1995 Howard
5,495,952 A 3/1996 Kainz
5,495,954 A 3/1996 Schmit
5,509,541 A 4/1996 Merl
5,529,192 A 6/1996 Conen et al.
5,566,844 A 10/1996 Bernardin
5,573,124 A 11/1996 Frost
5,582,116 A 12/1996 Spimpolo
5,605,238 A 2/1997 Jacobs
5,607,070 A 3/1997 Hellyer
5,611,442 A 3/1997 Howard
5,638,644 A 6/1997 Bastian
5,653,349 A 8/1997 Dana et al.
5,660,287 A 8/1997 Tryon
5,697,507 A 12/1997 Blass
5,715,957 A 2/1998 Merl
5,722,544 A 3/1998 Williams
5,769,247 A 6/1998 Merl
5,819,958 A 10/1998 Dement
5,848,711 A 12/1998 Schmit
5,852,904 A 12/1998 Yu et al.
5,870,867 A 2/1999 Mitchell
5,899,035 A 5/1999 Waalkes et al.
5,906,079 A 5/1999 Brickner et al.
5,918,750 A 7/1999 Jackson
5,921,411 A 7/1999 Merl
5,938,367 A 8/1999 Olson
6,021,613 A 2/2000 Reuter et al.
6,044,986 A 4/2000 Wood
6,079,173 A 6/2000 Waalkes et al.
6,115,978 A 9/2000 Bastian et al.
6,161,347 A 12/2000 Yu et al.
6,164,467 A 12/2000 DePottey et al.
6,193,083 B1 2/2001 Wood
6,520,355 B1 * 2/2003 Pritchard et al. ..... 211/187
6,659,295 B1 * 12/2003 De Land et al. ..... 211/187

* cited by examiner

ADJUSTABLE SHELVING/DISPLAY SYSTEM

This application is a divisional application of U.S. application Ser. No. 09/812,758 filed Mar. 20, 2001 U.S. Pat. No. 6,659,295, which is a continuation-in-part application of U.S. application Ser. No. 09/534,925 filed Mar. 23, 2000, now U.S. Pat. No. 6,520,355 issued Feb. 18, 2003, which claims priority to U.S. Provisional Application Ser. No. 60/126,457 filed Mar. 26, 1999.

FIELD OF THE INVENTION

This invention relates generally to shelving display systems and modular workstations. More particularly, the invention relates to a system for improving or replacing conventional gondola shelving units, thereby providing a more useful shelving display and workstation product.

BACKGROUND OF THE INVENTION

A conventional prior art gondola 10 is illustrated in FIG. 1. This gondola is often referred to as a "half gondola", since its base 12 extends only forward from upright base posts (or "uprights") 14 and 16. In a "full gondola", the base extends on both sides of the line defined by posts 14 and 16. Upright base posts 14 and 16 are attached to the gondola by conventional attachment means. Such conventional attachment means include pre-formed apertures in the base for receiving the distal ends of the posts. In this arrangement, means are provided for locking the posts in place using, for example, a locking bolt or sliding tab mounted in the base that engages the post surface. Alternatively, the posts may be bolted to outside vertical surfaces of the base. In another, less common arrangement, the posts may be part of a supporting skeletal structure which is covered with outer boards to form the base.

Posts 14 and 16 of gondola 10 include a series of spaced apertures 18 on the front and/or rear surfaces 19 of the posts. The gondola also includes a series of fixtures mounted to the base posts. For example, in FIG. 1, shelves 20*a*, 20*b*, and 20*c* rest respectively on shelf brackets 22*a*, 22*b*, and 22*c*, which are mounted in apertures 18 of the base posts. In a full gondola, the posts would have apertures on their front and rear surfaces, and shelf brackets and shelves would be mounted to the apertures on the front and rear surfaces of the posts.

While conventional gondolas of the type illustrated in FIG. 1 are highly functional and widely used, they do have certain shortcomings. For example, only one horizontal shelf can be located at a particular height, and the shelf lengths are determined by the spacing between the posts to which the shelves are mounted. Also, there is no convenient way to create visual pause points along the shelves. As a result, it is difficult to support and display different sizes and types of items on a single gondola or to create varying, visually pleasing configurations which are adaptable for a variety of retail environments.

Thus, a shelving display system that accepts shelves that are longer or shorter than the spaces between the gondola posts and permits mounting of different shelves at varying heights would be highly desirable. Additionally, a shelving display system which permits easy placement of pause point partitions between shelves on a single gondola would also be desirable.

The present invention provides such a system, as demonstrated, for example, in FIGS. 2A and 2B. As illustrated in FIG. 2A, the present system, identified by numeral 23, accommodates five different shelf widths in five columns divided by pause point partitions 25. The first and widest series of shelves 24 accepts rugs 27 that are best displayed when folded to a substantial width. The second, third and fourth columns of shelves 26, 28, and 30, are spaced to accept pillows 29 of varying sizes. Additionally, the shelves in these sections are at varying heights, to improve the visual interest of the shelving display system. A column of shelves 30 is provided for blankets 31, which, like the rugs in the first column of shelves, are best displayed in a wide folded configuration. Lastly, signage is provided at the tops of the columns identifying the goods (blankets, pillows and rugs) displayed below. The system illustrated in FIG. 2A includes a feature end display 32 resting on the gondola feature end base at the right of the system. The shelving display system of FIG. 2A is thus far more functional and aesthetically pleasing than the conventional gondola unit of FIG. 1.

FIG. 2B shows a system 301 with three different shelf widths in five different columns 340, 342, 344, 346, and 348. The widest shelves 302 span two columns, with two columns of shelves 303 of equal width disposed beneath the shelves 302. Two columns of shelves 304 are supported adjacent to the shelves 302 and 303. As can be seen, the shelves in each column are at varying heights to accommodate articles of different sizes and shapes. This type of shelving system 301 can be freestanding or attached to a wall 99 (as shown) and is particularly suitable for use in a pharmacy. The system of FIG. 2B provides more flexibility in arranging a shelving system to adapt to a greater variety of retail environments than the conventional gondola unit of FIG. 1.

SUMMARY OF THE INVENTION

The present invention is directed to a shelving display system and/or workstation that may be constructed on a conventional gondola shelving unit or used in place of such conventional gondolas. A gondola shelving unit may include a generally horizontal base and at least two upstanding base posts. The gondola may be provided with wheels on its underside to permit it to be moved from place to place. In accordance with one aspect of the invention, generally horizontal top and bottom tracks are attached to the base posts, a wall or other similar support surface. Then, support/display members are attached to the top and bottom tracks at desired locations. One or both of the tracks may be provided with a series of apertures for receiving attachment devices associated with the support/display members.

In one embodiment, the support/display members include at least one decorative panel. This decorative panel is mounted between the top and bottom tracks. Vertically directed slots may be provided in one or both of the top and bottom tracks in order to facilitate the mounting of the panel.

In another preferred embodiment, support/display members in the form of vertical pause point partitions are provided. The pause point partitions may be attached to the top and bottom tracks at locations dictated by the desired display system configuration.

In yet another desirable embodiment, the support/display members include at least two generally vertical uprights (also known as "standards") attached to the top and bottom tracks. These standards are configured to receive conventional shelf brackets and other components to create modular cabinets and work stations. Since the standards may be attached at varying locations along the length of the top and bottom tracks dictated by the desired system configuration, the system will accommodate a broad range of shelving and other component lengths.

In a further embodiment of the invention, the top and bottom tracks are attached to a wall or other similar support surface, without the need for the horizontal base and upstanding base posts found in a conventional gondola.

The objects, features and advantages of the present invention, as highlighted above, will be further described in the following description, drawings and claims.

BRIEF DESCRIPTION OF THE DRAWINGS

FIG. 8 is a perspective view of a mounting bracket designed for attachment to the tracks of. FIGS. 5 and 7;

DETAILED DESCRIPTION OF THE INVENTION

Figure 1:
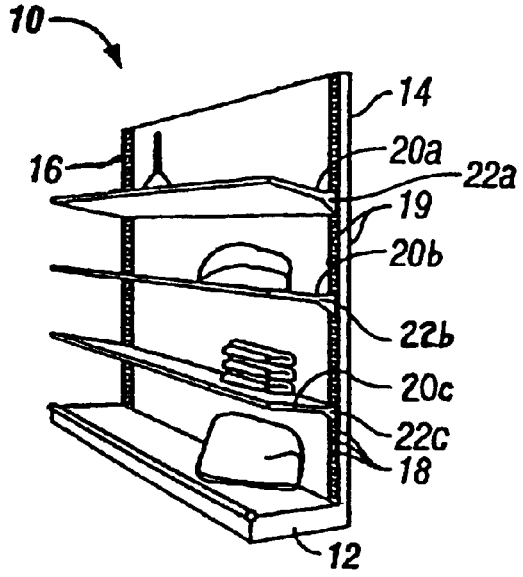
FIG. 1 (Prior Art)
FIG. 1 is a perspective view of a prior art half-gondola.
Figure 2A:
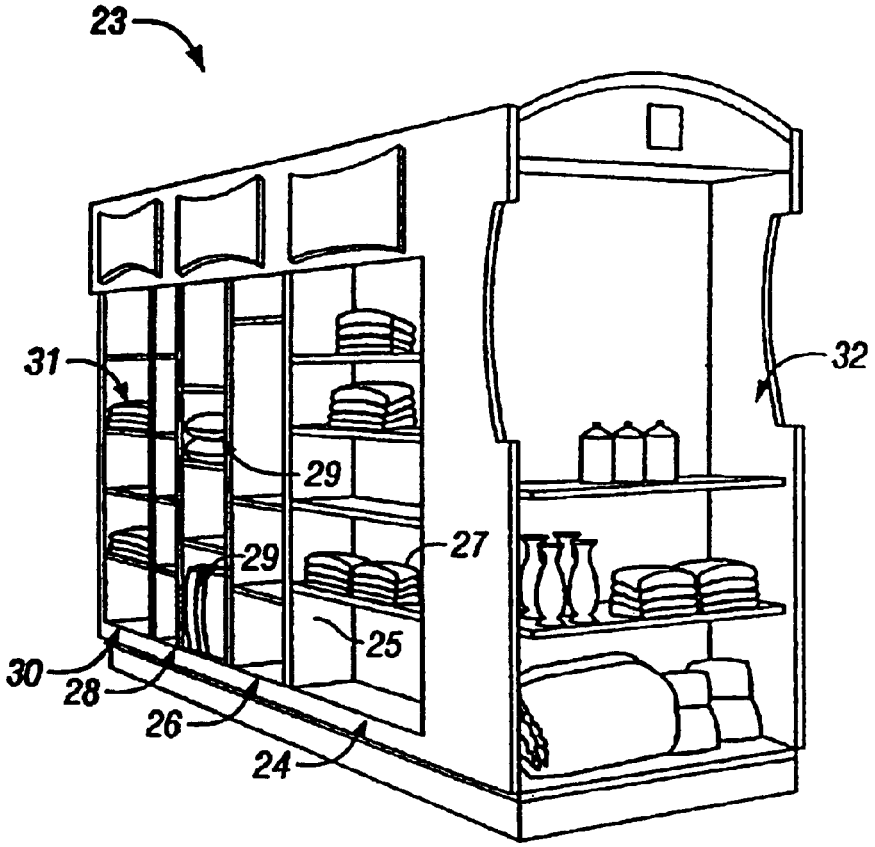
FIG. 2A is a perspective view of a fully assembled shelving/display system in accordance with the present invention.
Figure 2B:
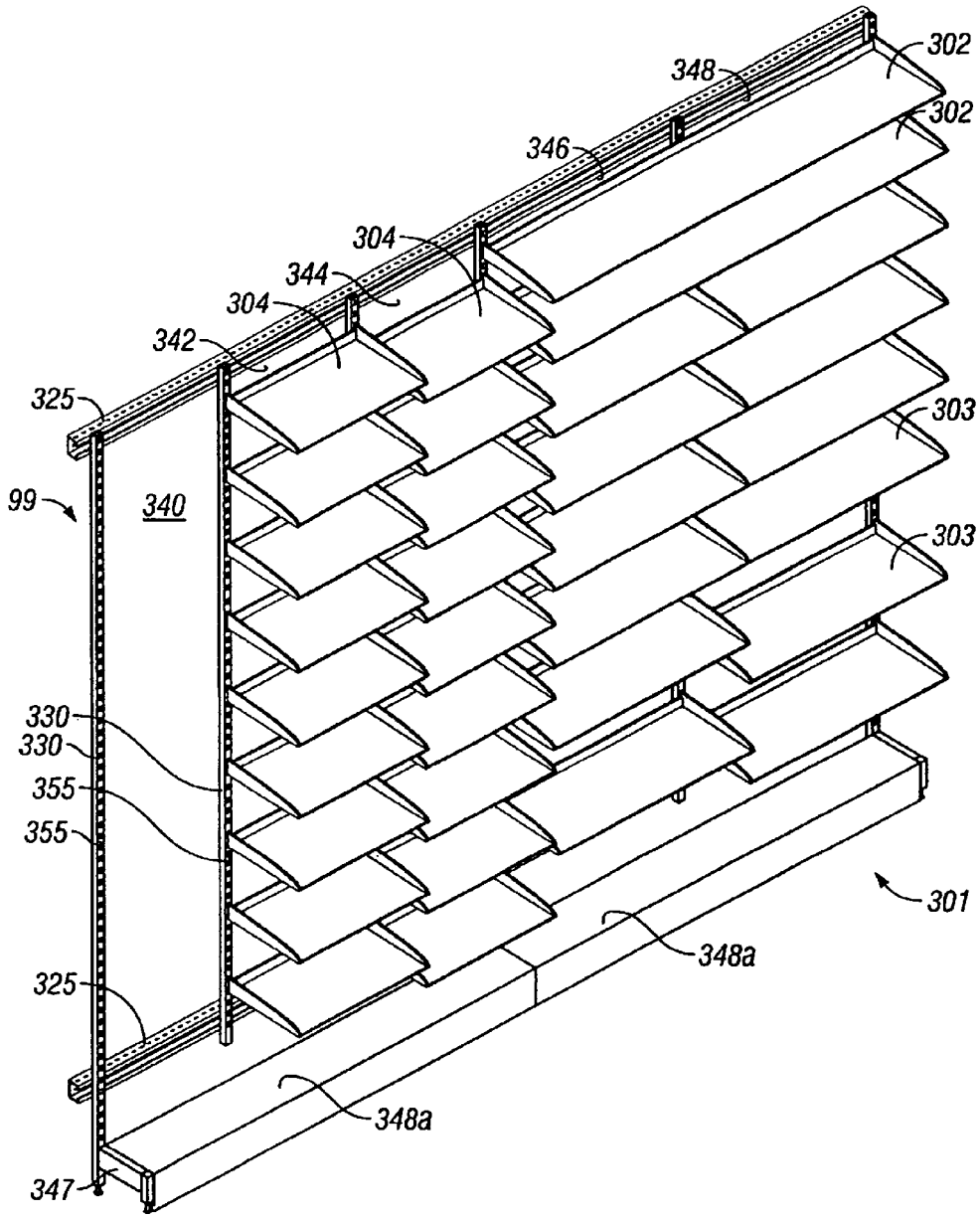
FIG. 2B is a perspective view of another embodiment of a fully assembled shelving/display system in accordance with the present invention.
Figure 3:
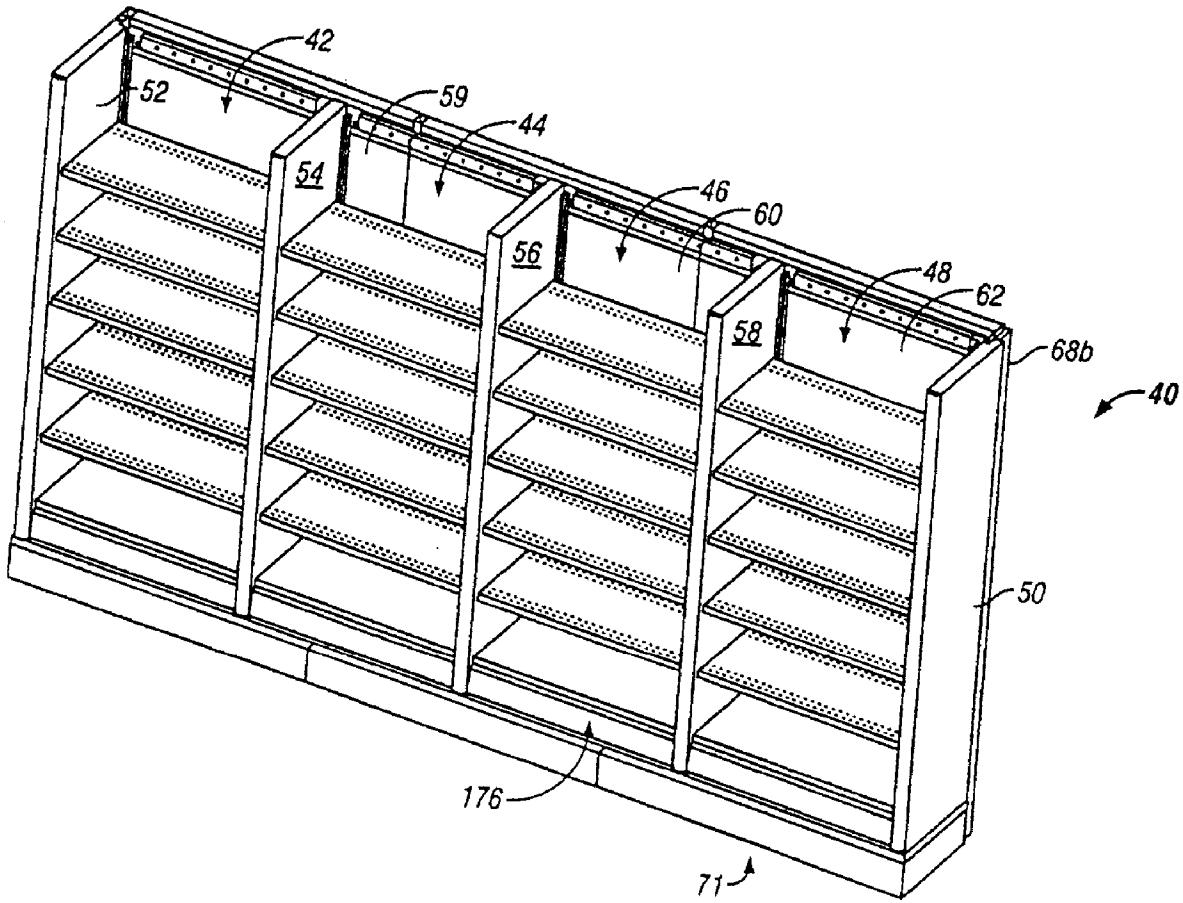
FIG. 3 is a perspective view of another shelving/display system in accordance with the present invention.

Turning now to FIG. 3, a shelving display system 40 is illustrated. Shelving display system 40 includes four evenly-spaced columns of shelves 42, 44, 46, and 48 with end caps 50 and 52, and pause point partitions 54, 56, and 58 between the four columns of shelves. Although columns of shelves 42, 44, 46, and 48 are evenly spaced in this FIG., these columns may by of varying widths, as in FIG. 2A and 2B. Additionally, decorative panels 59, 60 and 62 illustrated in FIG. 3 are provided to form a backdrop for the system.

Figure 4:
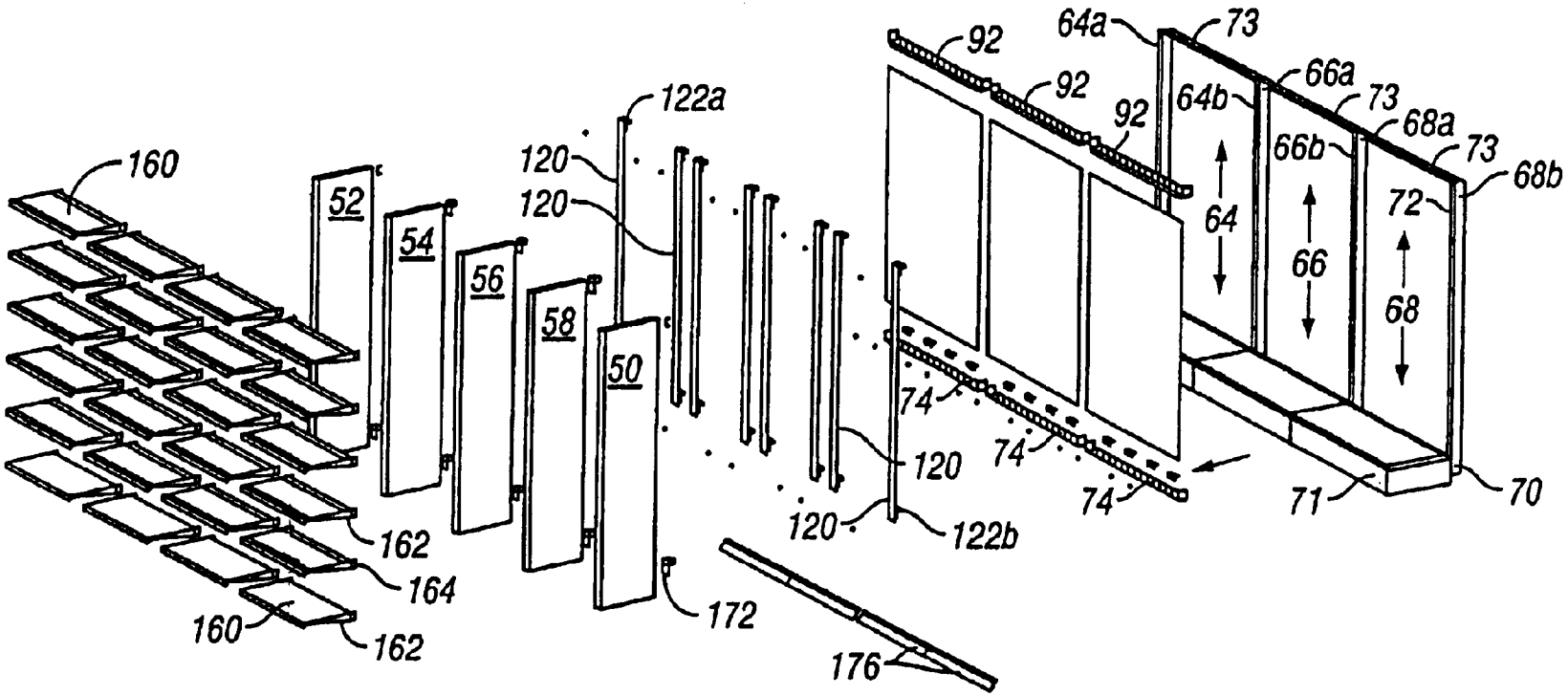
FIG. 4 is an exploded view of the system shown in FIG. 3.

FIG. 4 is an exploded view of the shelving display system of FIG. 3. Beginning at the right hand edge of the view, a series of three conventional gondola units, 64, 66, and 68, are illustrated, each having a pair of upstanding base posts (64*a* and 64*b*, 66*a* and 66*b* and 68*a* and 68*b*, respectively) secured to rear corners 70 of each base 71, along the rear vertical surface of the base. These upstanding posts include a series of apertures 72 running their entire length. Additionally, optional horizontal stabilizer rails 73 are attached to each pair of posts to help stabilize the posts of the gondola units. Although the upstanding posts are shown attached at opposite ends of the bases, one or both posts may be located in apertures in the base at intermediate locations leaving the base with clear end areas so that, for example, other display and support units may be placed on these end areas as, for example, at 32 in FIG. 2A. Also, where long bases are used or where extra support is desired, more than two upstanding posts may be used.

Figure 5A:
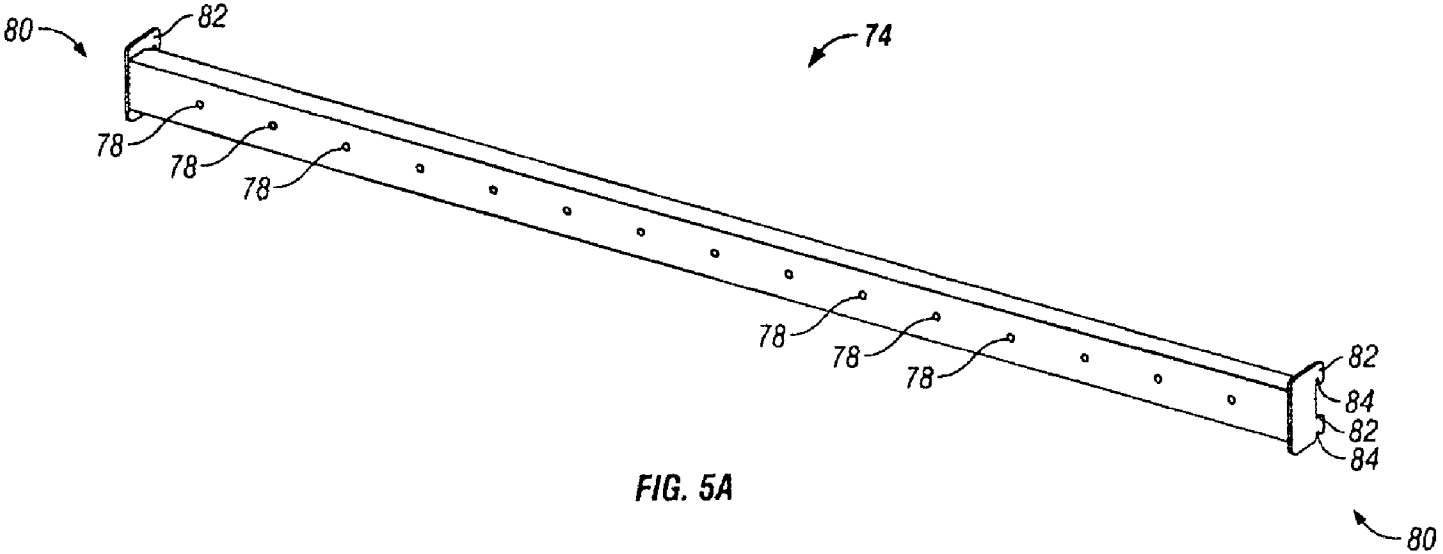
FIG. 5A is a perspective view of a track intended to be mounted horizontally in the shelving/display system of the present invention.
Figure 7:
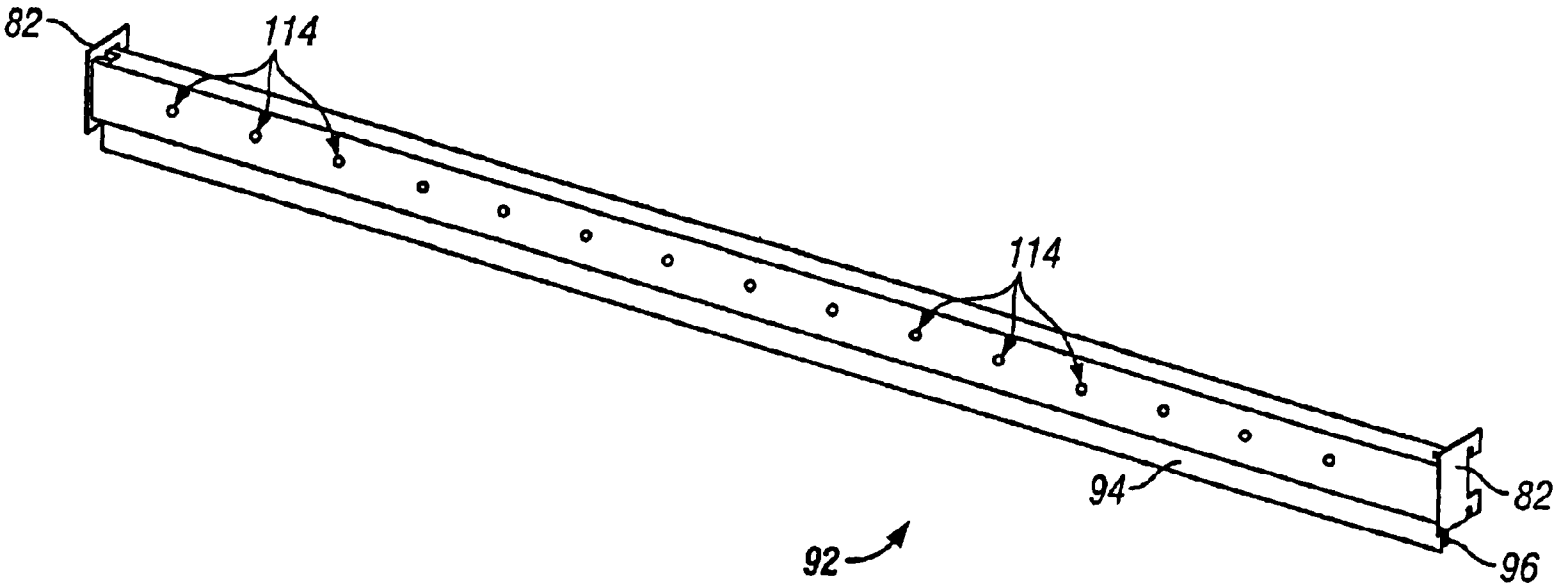
FIG. 7 is a perspective view of another track, comprising an alternative design to that of FIG. 5A.

Continuing left in FIG. 4, a series of three generally horizontal top tracks 92 and three generally horizontal bottom tracks 74, in accordance with the invention, are shown. These tracks, which are illustrated in greater detail in FIGS. 5A and 7, are mounted in the desired apertures 72 of gondola posts 64*a* and 64*b*, 66*a* and 66*b*, and 68*a* and 68*b*. Although not shown in this illustrative embodiment, additional horizontal tracks can also be mounted to the gondola posts at selected locations between the top and bottom horizontal tracks to form tiers of horizontal tracks.

As shown in FIG. 5A, track 74 has a series of apertures 78 along its length and mounting brackets 80 at either end. Although apertures 78 are illustrated as round through-holes, they may be blind holes and of any shape or depth which will receive and hold the engagement section of associated locking members with a shelf/display member. Alternatively, the tracks need not be provided with apertures in which case the shelf/display members will be fastened by alternate means such as clamp devices.

Mounting brackets 80 have downwardly projecting prongs 82. Thus, the horizontal tracks may be mounted to the upstanding posts at either end of each gondola by pushing prongs 82 into the apertures of the posts at the desired height, and then locking the track into place by forcing or lowering it downward so that the slots 84 in the brackets engage a portion of the posts just below each aperture holding a prong. This mounting system generally follows that already known for mounting shelf brackets to upstanding posts of conventional gondola units.

Figure 5B:
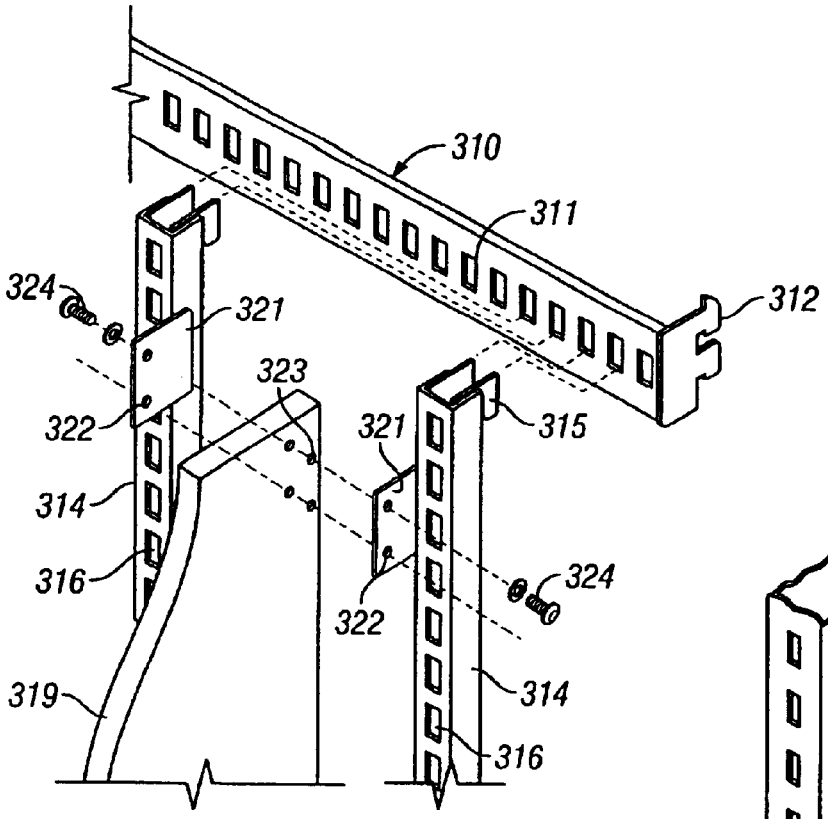
FIG. 5B is a perspective view of another embodiment of a horizontal track of the present invention.

In another embodiment shown in FIG. 5B, track 310 has a series of apertures 311 along a front surface and mounting prongs 312 at either end. Although apertures 311 are illustrated as elongated slots, they may be holes of any suitable shape and size to receive and hold the engagement section of an associated shelf/display member 314. As shown in FIG. 5B, a vertical support/display member or upright standard 314 is provided with one or more prongs 315 located along its length (preferably at both its top and bottom ends) to engage apertures 311 in track 310. A series of receiving slots 316 run the length of standard 314 to receive fixtures such as shelving or other display or workstation component attachment members.

Figure 5C:
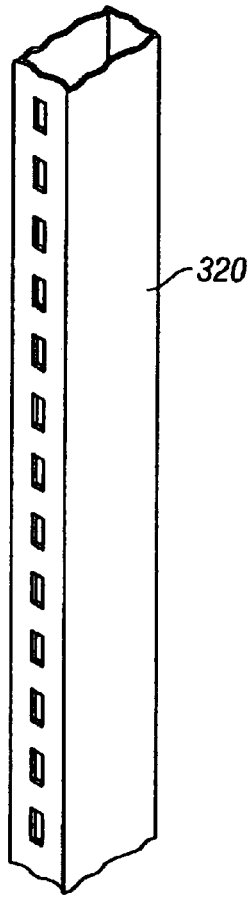
FIG. 5C is a partial perspective view of a vertical post for use in one embodiment of the present invention.
Figure 18:
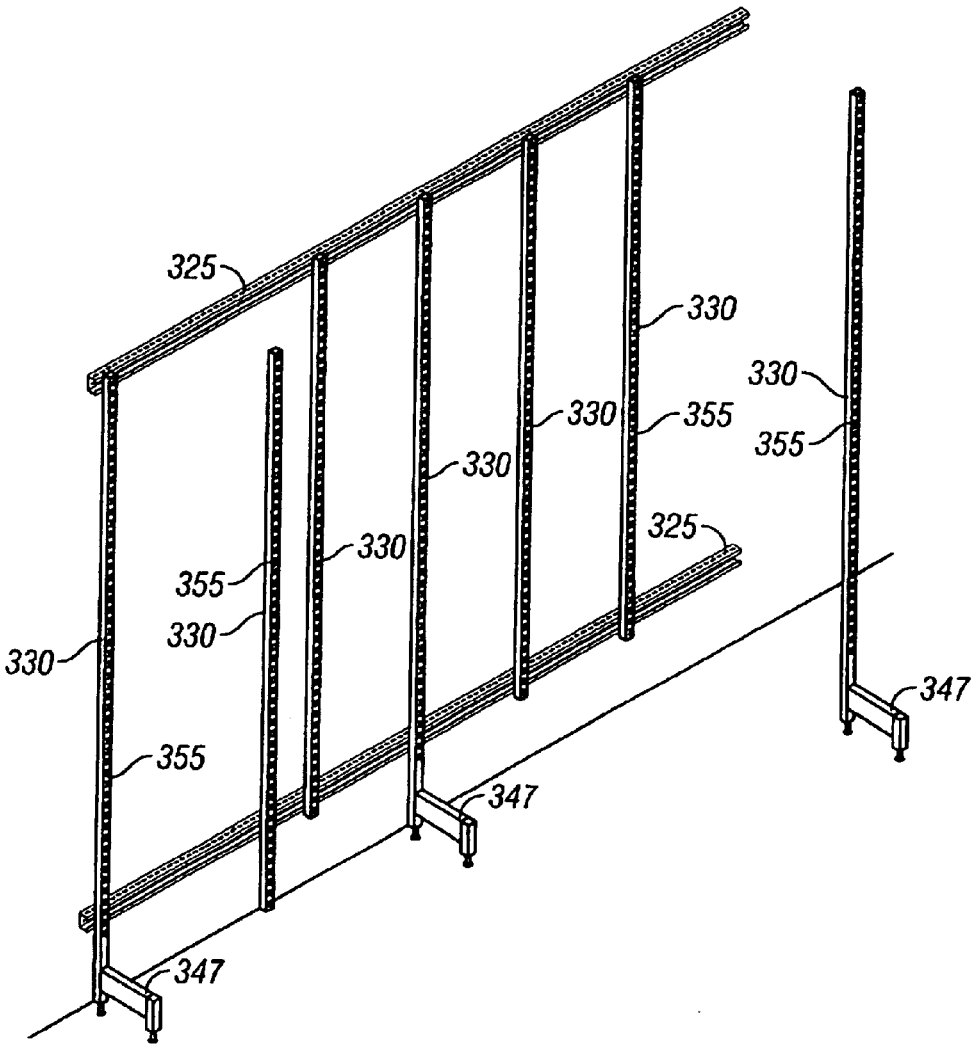
FIG. 18 is a partially exploded perspective view of a wall-mounted shelving/display system in accordance with the present invention.
Figure 19:
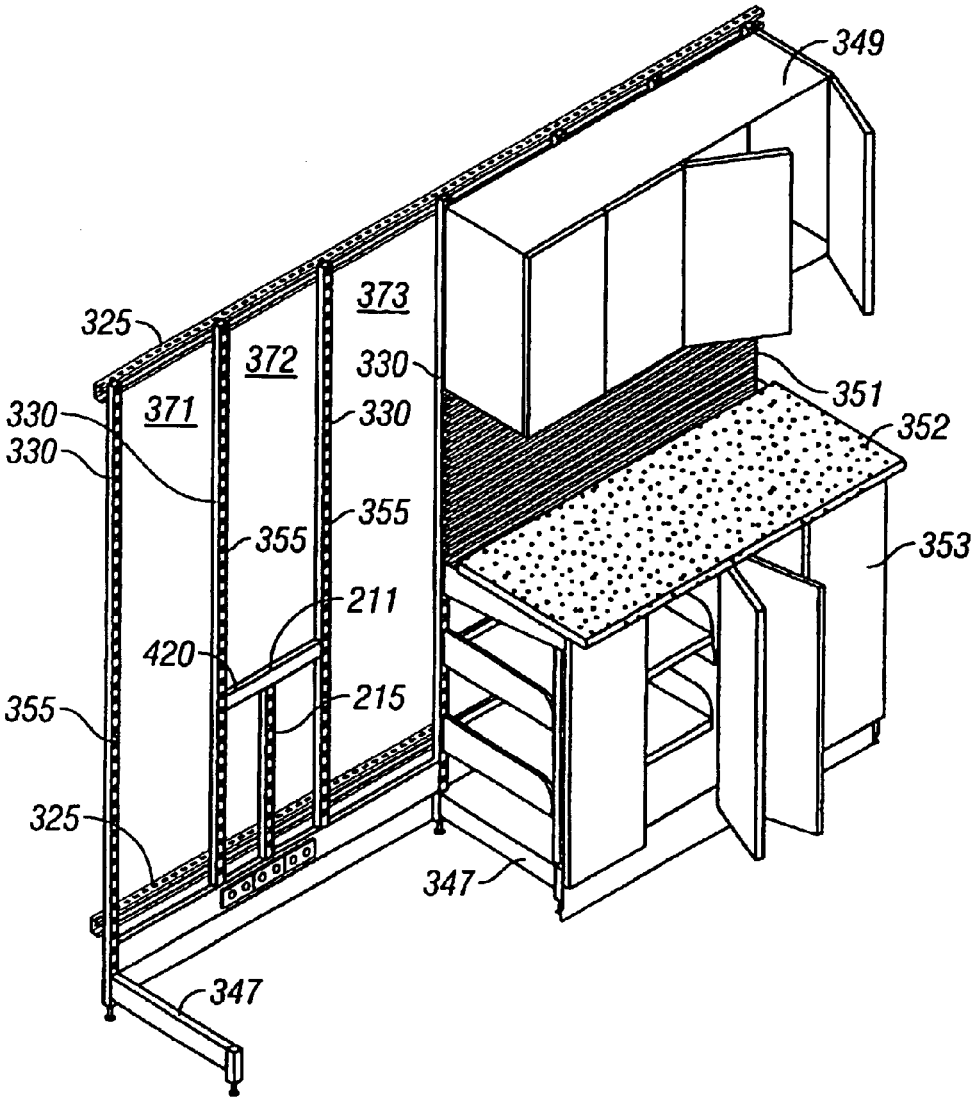
FIG. 19 is a perspective view of another embodiment of a wall-mounted shelving/display system in accordance with the present invention.

It is contemplated that a pair of upper and lower horizontal tracks 310 will run between two vertical gondola posts 320 (see FIG. 5C), which posts may be supported by a standard gondola base as illustrated, for example, in FIGS. 3, 4, 6 and 20. Alternatively, horizontal tracks 310 may be mounted to a wall or other similar supporting surface as illustrated in FIGS. 2B, 18 and 19. Upper and lower tracks 310 thus provide a system for attaching upright standards 314 at any number of locations along the length of the tracks 310 so as to create columns of varying widths for supporting shelving or the like. Such a system is highly adaptable to accommodate the need for shelving and workstation configurations of varying widths and heights not possible with conventional gondola systems.

As shown in FIG. 5B, partition 319 can be secured at selected locations along the length of tracks 310 as desired to create visual pause points. In the embodiment, a pair of standards 314 are provided with wings 321 to securely hold a partition between the standards. Bolts or screws 324 (or any other suitable attachment means) extend through holes 322 in wings 321 and holes 323 in partition 319 to attach the partition to the pair of supporting standards. Via prongs 315 associated with standards 314, these components can then be secured as a single unit into selected apertures 311 in the upper and lower tracks 310 between shelving columns to create visual pause points. In an alternate embodiment, partition 319 can be mounted to the upper and lower tracks 310 by prongs 315 extending directly from the partition.

Figure 6:
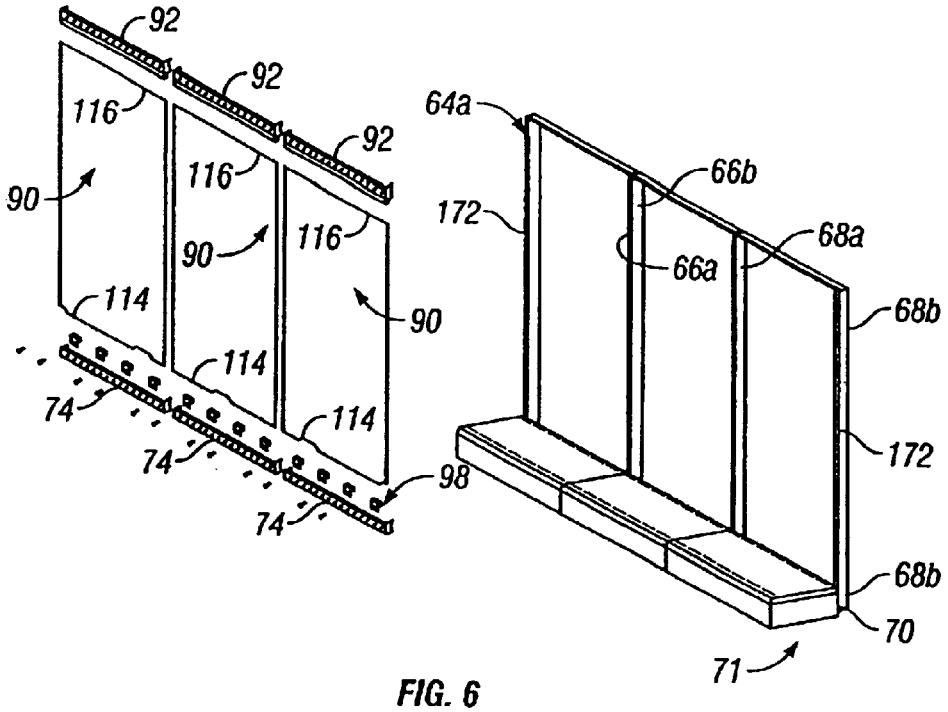
FIG. 6 is a partial exploded view of the embodiment of FIG. 3, illustrating the positioning of the decorative panels of the system.
Figure 8:
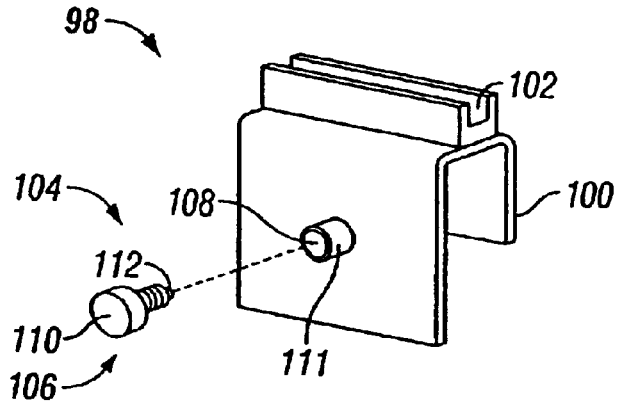

The retention or mounting of decorative back panels 59, 60 and 62 may be best understood by reference to FIGS. 6, 7 and 8. Beginning in FIG. 6, panels 59, 60 and 62 are shown juxtaposed below specially adapted horizontal tracks 92. As illustrated in FIG. 7, each track 92 is provided with a downwardly projecting portion 94 defining a downwardly projecting panel retention space or slot 96. The width of slot 96 will be slightly greater than that of the decorative panels, so that the panels can be slid into the slots and retained there, as explained below. Next, three tracks 74 are juxtaposed below the panels with a series of releasable locking elements or panel brackets 98 between the panels and the tracks.

Figure 9:
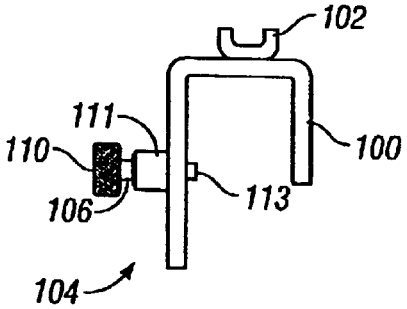
FIG. 9 is a side elevation view of the bracket of FIG. 8.
Figure 10:
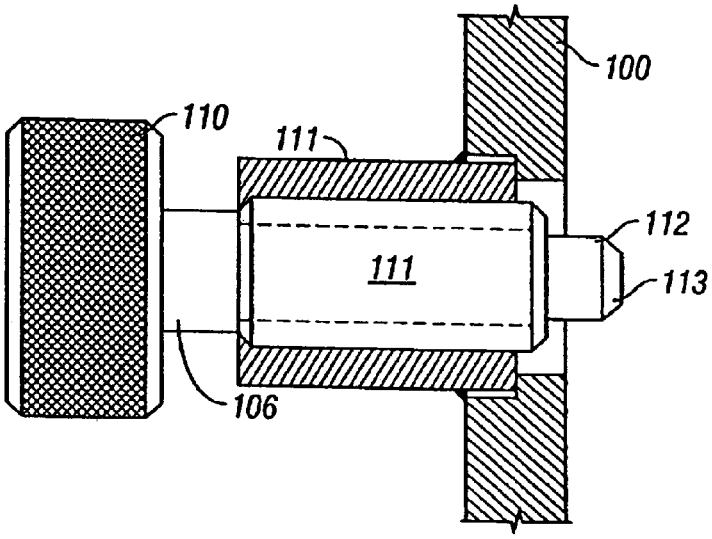
FIG. 10 is an enlarged cross-sectional view of the bracket of FIGS. 8 and 9.

As shown in FIGS. 8, 9 and 10, panel brackets 98 include a saddle portion 100, an upper panel retention trough 102, and a locking member 104. Locking member 104 includes a spring biased plunger 106 which fits through an aperture 108 in the front wall of the saddle portion. Plunger 106 is attached to a spring within collar 111 which biases the plunger into the rest or engagement position shown in FIG. 10. The plunger includes a head portion 110 and an engagement portion 112 having a guide tip 113. Engagement portion 112 is sized and positioned to engage and to rest within any one of apertures 114 in track 92 or 74. Guide tip 113 helps guide the plunger into the desired aperture. Thus, the locking member is pulled out and the retainer placed on the track and slid along the track until guide tip 113 is opposite the desired aperture in the track, whereupon the locking element is released and both engages and is held in place by the spring action of the biasing spring.

The decorative panels are mounted by first positioning panel brackets 98 along tracks 74 by retracting the plungers 106, positioning the locking members at the desired locations on the tracks, and releasing the spring-biased plungers to fix the panel brackets 98 in place. Then each of the panels in turn is positioned opposite a slot 96 in its respective panel track 74 and pushed up into the slot, whereupon the saddle portions of the panel brackets 98 on each lower track 74 are slid onto the bottom edge 114 of the corresponding panel, and the lower tracks are attached to the corresponding pair of upstanding posts 64*b*, 66*a* and 66*b*, and 68*a* and 68*b* by pushing prongs 82 into apertures 78 and allowing the prongs to drop into place as the panel slides downwardly in slot 96 a short distance while the top edge 116 of each panel remains in the slot. The panel is thus fixed in place.

In alternative embodiments, the positions of the top panel track and bottom track may reversed. In this embodiment, the panels would first be dropped into the slots in the bottom panel tracks, and then the top tracks would be attached to the panel top edges and then mounted to the upstanding posts with the top edges positioned in the panel retention troughs. In a further embodiment, identical tracks could be used on the top and bottom, with panel brackets 98 along each track. In yet another alternative embodiment, top and bottom tracks with slots could be used.

Figure 20:
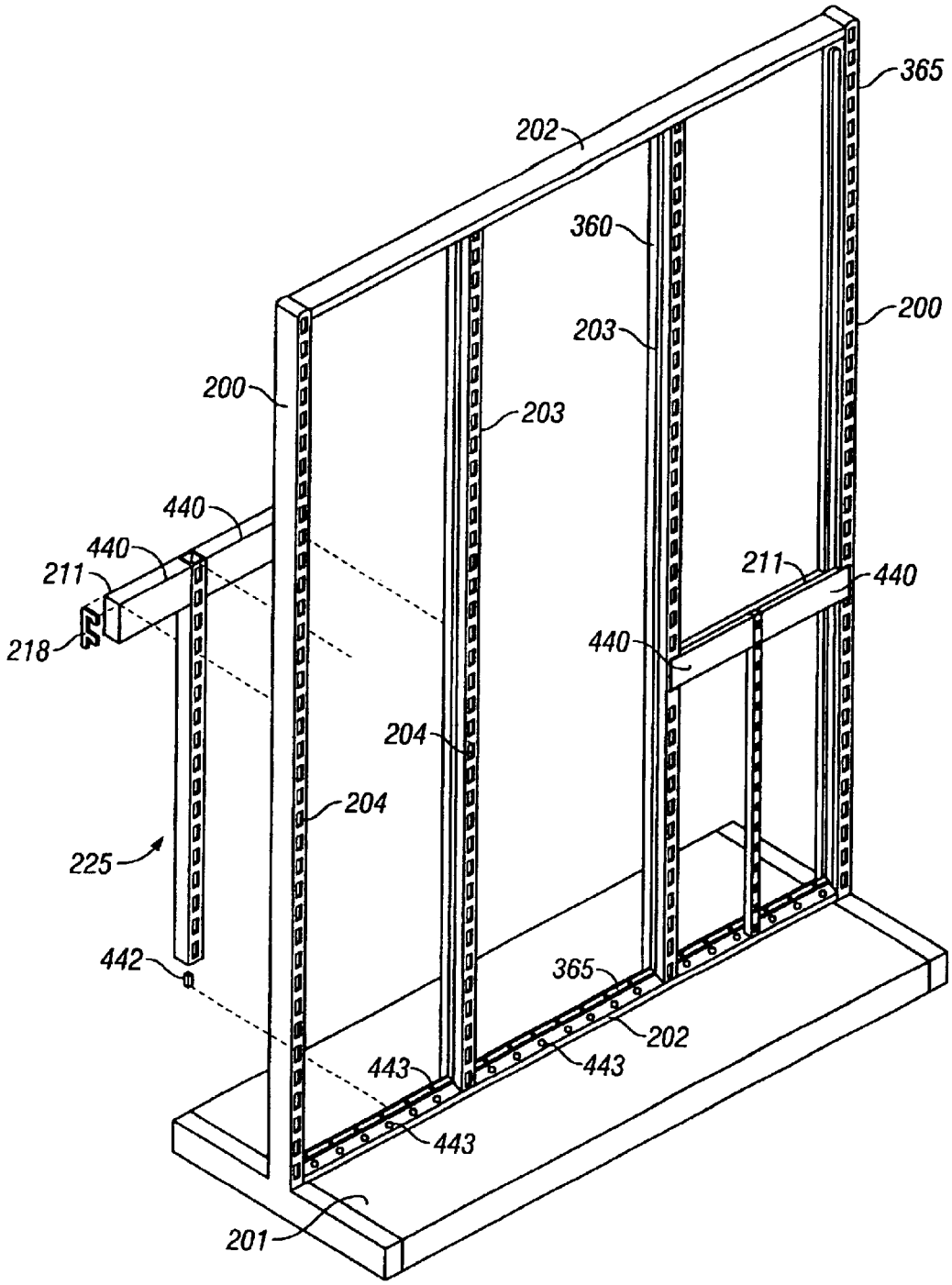
FIG. 20 is a partially exploded perspective view of a freestanding unit in accordance with the present invention.
Figure 21:
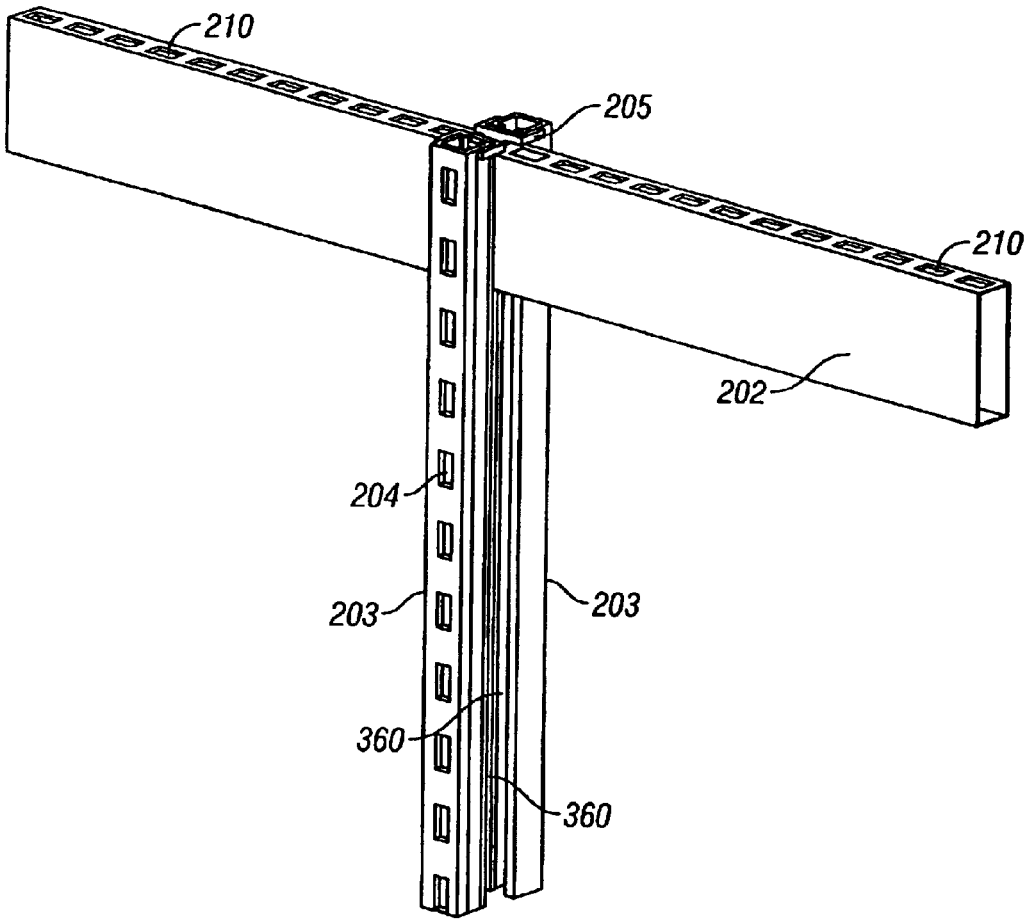
FIG. 21 is a perspective view of one embodiment of a horizontal track for use in the unit of FIG. 20.
Figure 22:
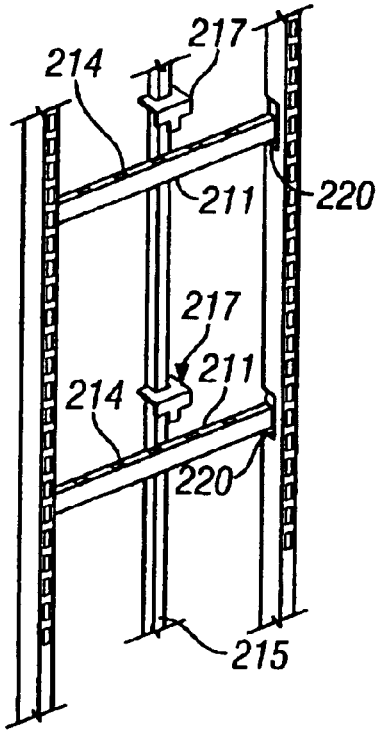
FIG. 22 is a partial perspective view of intermediate horizontal tracks and upright for use with the unit of FIG. 20.
Figure 26:
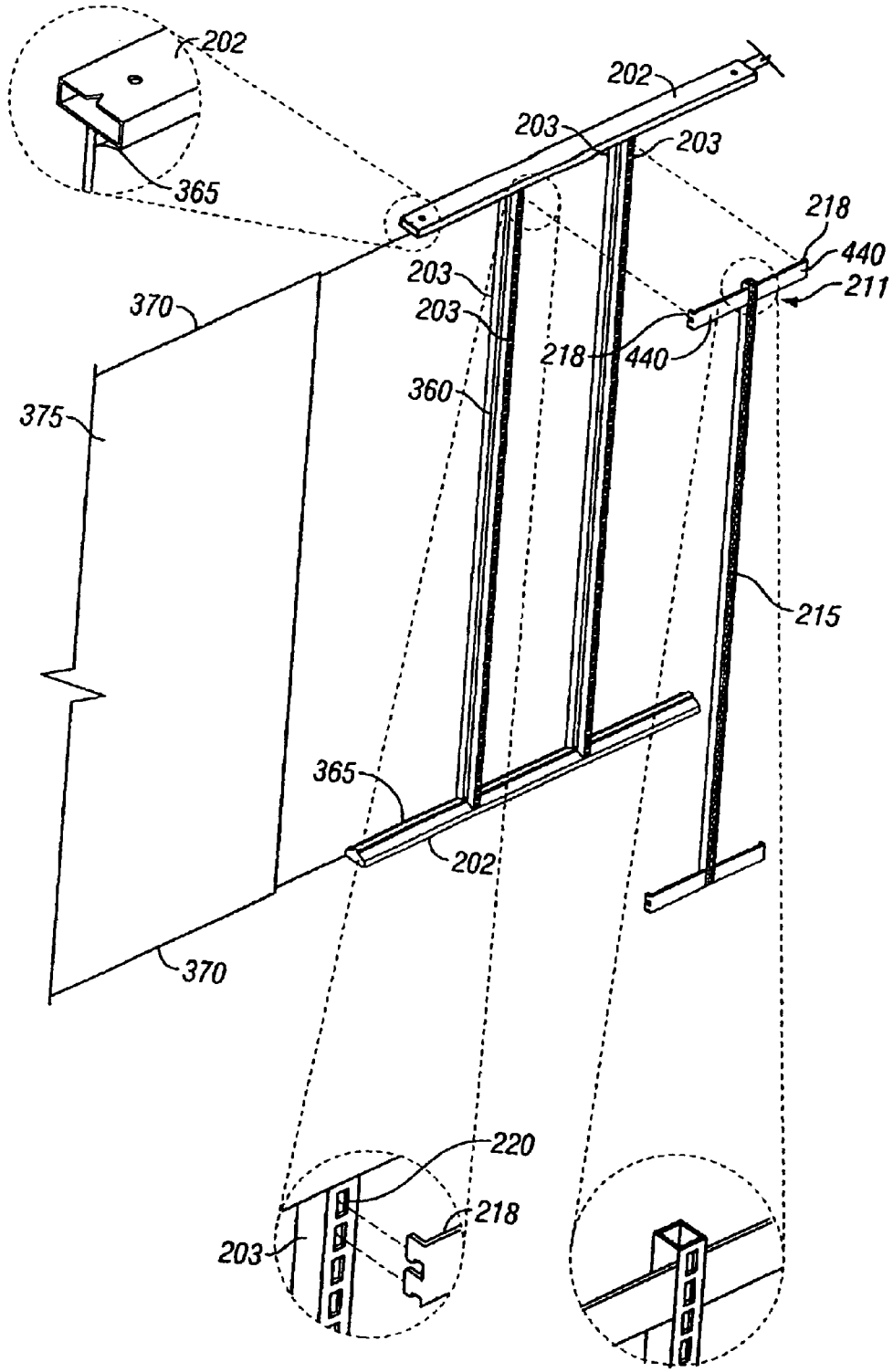
FIG. 26 is an exploded partial perspective view of another embodiment of the present invention.

In another alternative embodiment, pairs of back-to-back uprights 203 are attached along the length of horizontal tracks 202 as illustrated in FIGS. 20, 21 and 26. Mounting the uprights 203 in this back-to-back configuration creates a space 360 between the uprights in which a decorative panel can be sandwiched and held. In one embodiment shown in FIG. 21 and described in more detail below, track 202 is provided with a series of spaced apertures along its top surface at which uprights 203 can be mounted back-to-back by means of brackets 205. In another embodiment (shown in FIG. 26), back-to-back uprights 203 are welded to horizontal tracks 202. In the preferred embodiment, tracks 202 and gondola posts 200 feature a U-shaped groove or channel 365 for receiving the edges 370 of the panel 375.

The attachment of the columns of fixtures, such as the columns of shelves 42, 44, 46 and 48 of FIGS. 3 and 4, will now be described beginning with reference to FIG. 11. First, the system is provided with a series of conventional standards 120, modified by attaching at least two standard brackets 122*a* and 122*b*, preferably at the top and bottom ends, 124 and 126, respectively, of the standards. The brackets may be welded to or integrally formed as part of the standards. These standards are, as illustrated, conventional square posts 126 having elongated slots 128 at least along their front surface 129. Posts 126 need not be square and variations may be made in the shape or size of the apertures. Furthermore, brackets 122*a* and 122*b* need not be attached at the ends of the standards, but may be attached at locations spaced from one or both ends of the standards.

Figure 13:
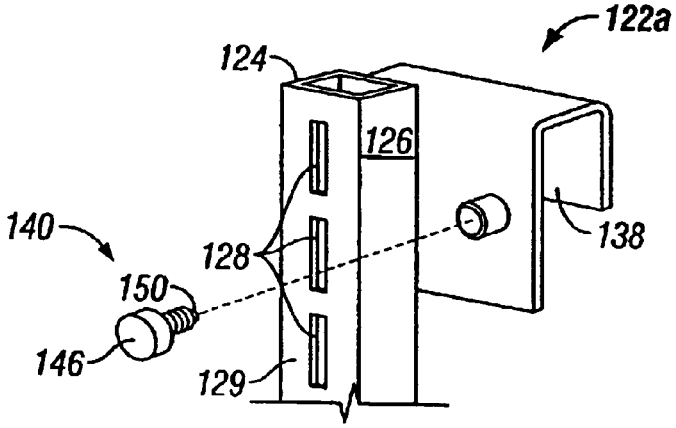
Figure 11:
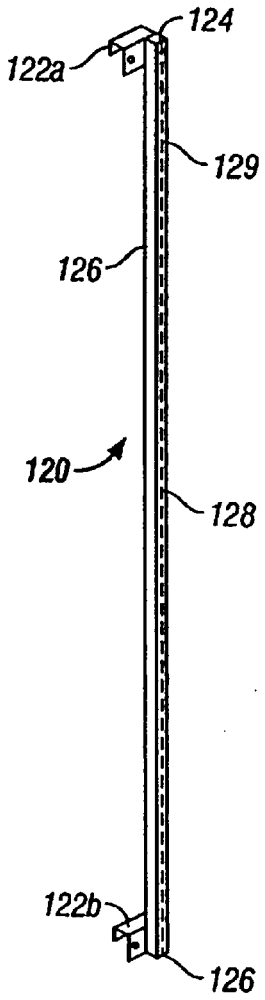
FIG. 11 is a perspective view of a vertical standard having brackets at either end for attachment to the tracks of FIGS. 5 and 7.

Brackets 122*a* and 122*b* which are intended to rest on top and bottom tracks 92 and 74 may be centered laterally on the upright standards, or they maybe offset to the left as in FIG. 11, or to the right. Thus, the left offset bracket of FIG. 11 is best adapted to be used on the extreme right edges of a pair of tracks, whereas a standard which has a pair of brackets offset to the right is best adapted to be positioned at the extreme left ends of a pair of tracks (FIG. 13). Should it be desired to make the brackets the same width as the standards, the brackets may be centered on the backs of the standards. Also, the attachment brackets may be fixed to the standards with a portion of its back surface protruding above and below the ends of the standard.

Figure 12:
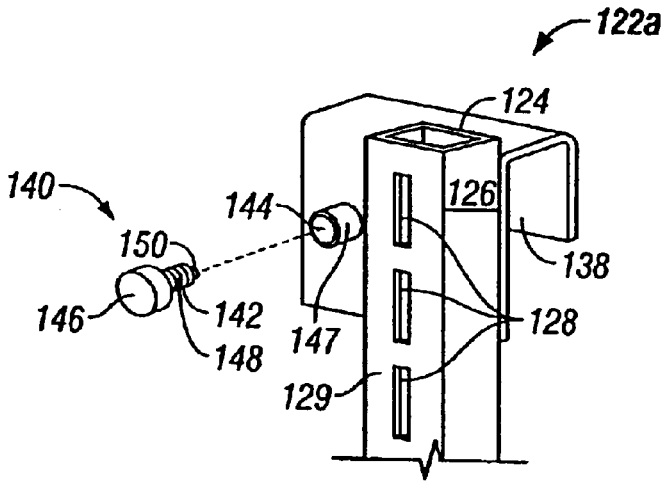
FIGS. 12 and 13 are partial views of standards in accordance with the present invention in which brackets are attached respectively protruding left and protruding right.

In FIG. 4, pairs of brackets 122*a* and 122*b* are shown, before attachment to their respective pairs of top and bottom tracks 92 and 74. As illustrated in the enlarged view of FIG. 12, bracket 122*a* includes a saddle portion 138 and a locking member 140. As in the case of panel brackets 98, these standard brackets include a spring biased plunger 142 which fits through an aperture 144 in the front wall of the saddle portion, and is attached to a spring within collar 147. Plunger 142 includes a head portion 146 and an engagement portion 148 having a guide tip 150. Again, as in the panel brackets, engagement portion 148 is sized and positioned to engage and rest within any one of the apertures in tracks 74 and 92. Thus, plunger 142 is retracted and the standards positioned on the track and slid along until guide tip 150 is opposite the desired aperture in either the top or bottom track, whereupon the plunger is released to lock the end of the standard in place on the track.

Figure 15:
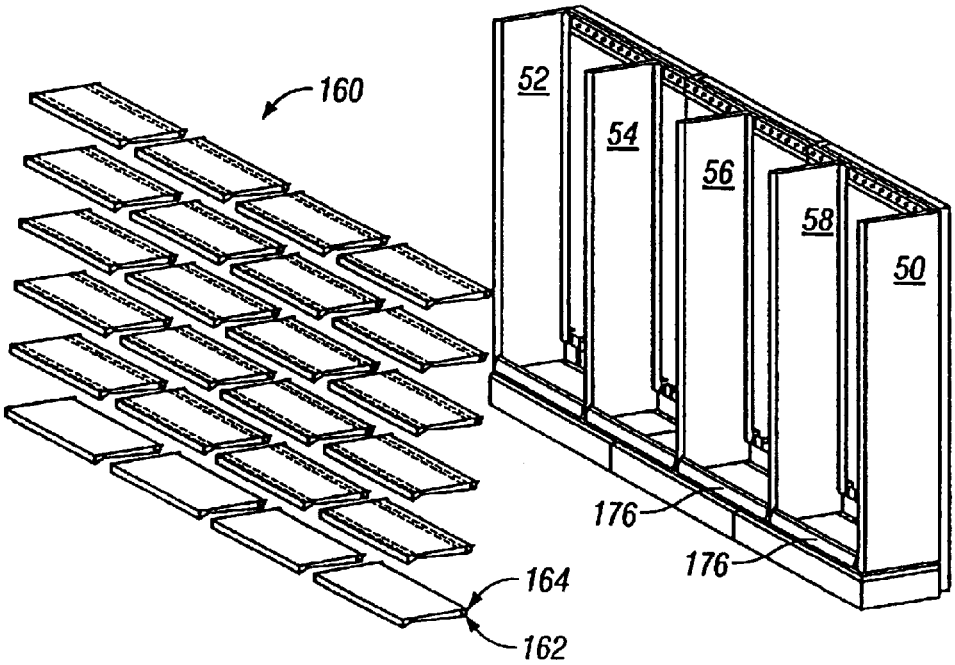
FIG. 15 is a partial exploded view of the system of FIG. 3 showing a series of shelves positioned for attachment to standards in the system.

A series of shelves 160 are illustrated in FIGS. 4 and 15, each having brackets 162 at either side. Brackets 162 can be integrally formed as part of the shelves or attached to the shelves using any suitable means, such as spot welding or bolting. Brackets 162 have hooks 164 at their rear edge. These hooks are of a size and shape which will engage slots 128 in the standards, in much the same way as conventional shelf brackets attach to conventional standards. Thus, the columns of shelves may be attached to the pairs of standards at the desired heights. If it is desired to use shelves of different widths, standards 120 are simply attached to the tracks at spacings corresponding to the desired shelf widths.

Figure 14:
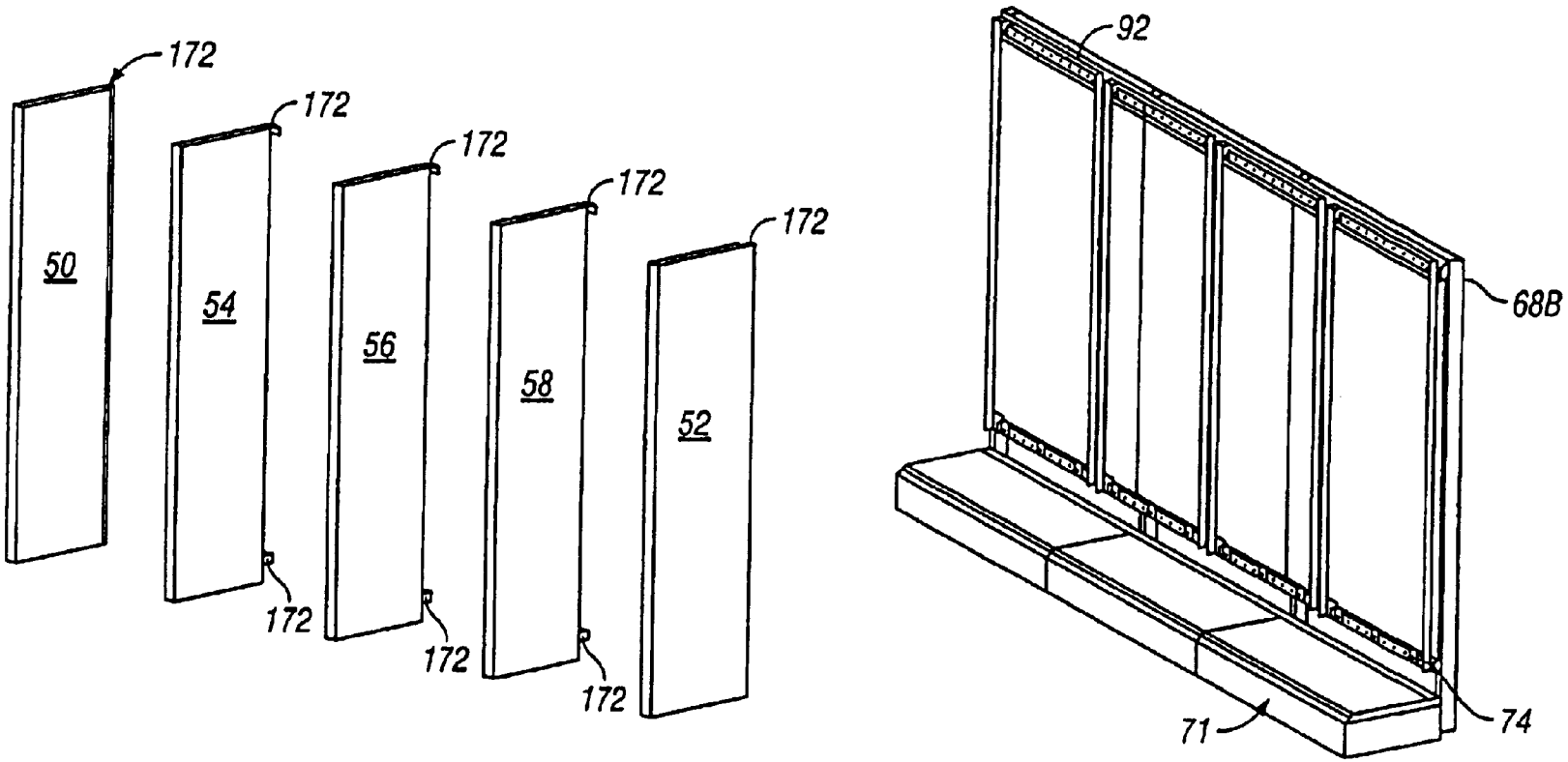
FIG. 14 is a partial exploded view of the system of FIG. 3 showing partitions and end caps positioned for attachment.

In order to complete the shelf/display system of FIG. 3, end caps 50 and pause point partitions 52, 54, 56 and 58, must be attached to the tracks (FIGS. 14 and 15). Each of the partitions and end caps are provided with pairs of hooks 172, permitting them to be hung on the tracks at the ends of the system and between immediately adjacent pairs of standards. The end caps may be further restrained by hanging them by brackets to the spaced apertures in the upstanding base posts. Yet further restraint may be obtained where desired by securing each of the end caps at their bottom edge to the gondola base.

Lastly, covers 176 may also be attached to the front surfaces of the bases, to further decorate the system. These covers may be provided with labeling corresponding to the merchandise above, if desired. Alternatively, signage may be attached to the system at its top (FIG. 2) or elsewhere in the system by conventional means.

Figure 16:
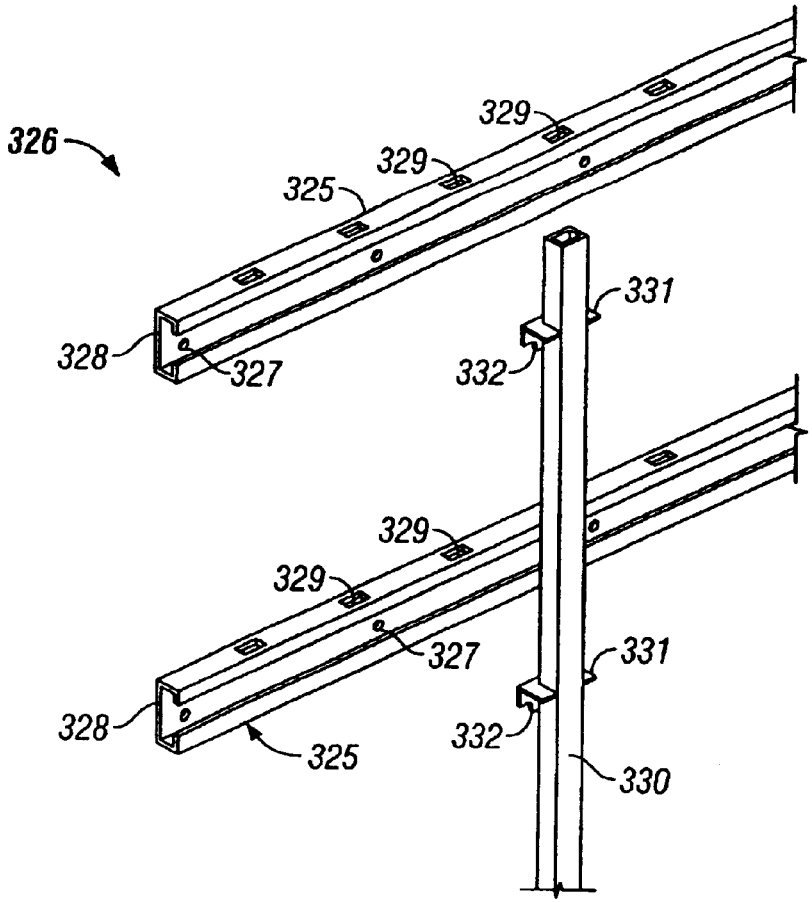
FIG. 16 is a partial exploded view of an alternative track and upright embodiment.
Figure 17:
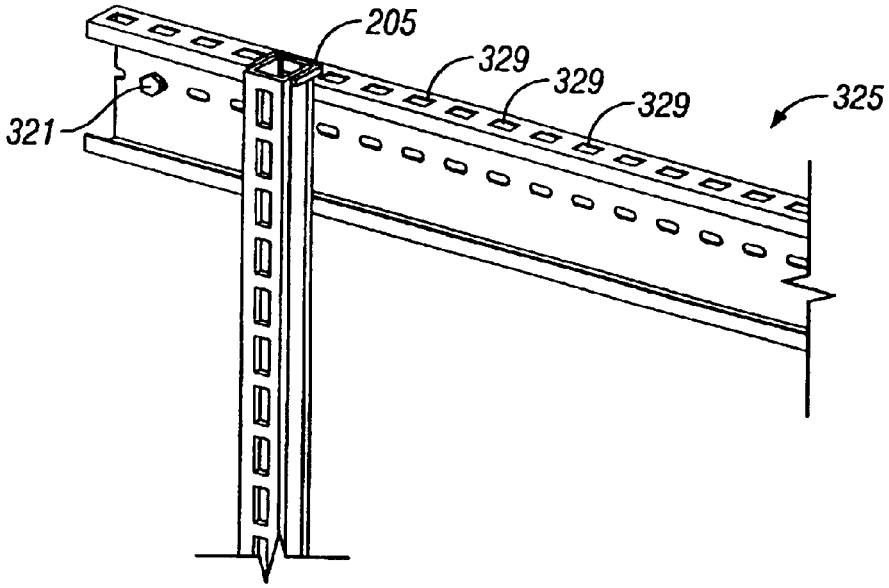
FIG. 17 is a partial perspective view of the upright and upper track of FIG. 16.

In yet another embodiment shown in FIGS. 16 and 17, horizontal upper and lower tracks 325 are designed for attachment to a wall 326. As shown in greater detail in FIG. 16, in one embodiment, tracks 325 are formed from C-shaped channel members which are provided with optional wall mounting holes 327 spaced along the web section 328. Any suitable bolt or screw 321 may be used to attach the tracks 325 to wall 326 by means of holes 327.

Slots 329 are provided along the top surface of each track 325 to engage and secure support/display members or uprights 330. Brackets 331 are welded to the uprights 330 and each bracket is formed with a downwardly extending tab portion 332 to engage and fit into a selected slot 329 in tracks 325. That is, one bracket 331 is welded to upright 330 proximate to the upper end of the upright to engage a selected slot in the upper track 325 and another bracket 331 is welded proximate to the bottom end of upright 330 to engage a selected slot in the lower track 325. Thus, the uprights 330 can be secured in any number of positions along the length of tracks 325 to form columns of varying widths by engaging brackets 331 in a pair of corresponding slots 329 on the upper and lower tracks 325. To secure upright 330 to the tracks 325, the brackets 331 are first aligned with a selected pair of corresponding slots 329 in the upper and lower tracks 325 and the upright 330 is then lowered so that the downwardly extending tab portions 332 of brackets 331 fit into and engage slots 329 and the brackets rest on the top surface of each track 325.

In an embodiment using the wall-mounted tracks 325 like those illustrated in FIG. 16, a wall-mounted system is shown in FIGS. 2B, 18 and 19 which is particularly useful in a pharmacy setting. The system comprises a pair of horizontal tracks 325 mounted to a wall or similar supporting surface by means of screws, bolts or any other appropriate attachment means. Uprights 330 are secured to tracks 325 to form columns 340, 342, 344, 346 and 348, with shelves 302–304 (FIG. 2B) secured to uprights 330 at selected heights. As best shown in FIG. 18, base support members 347 are secured to selected uprights 330 to support base covers 348*a* as shown in FIG. 2B. Both the base support members 347 and the uprights 330 to which they are secured are provided with levelers to ensure that the base covers 348*a* align with each other and are level.

Another embodiment of a wall-mounted system is depicted in FIG. 19, where fixtures such as overhead cabinets 349, a slatwall section 351, a workstation surface 352 and a modular cabinet unit 353 disposed under work surface 352 are all secured to the system by means of uprights 330. Each of these fixtures 349–353 are provided with brackets (not shown) along their rear edges to removably engage the apertures or slots 355 provided along the front surface of uprights 330. The cabinets 349, slatwall 351, workstation 352 and cabinet unit 353 may thus be secured to the uprights 330 in a wide variety of configurations, in much the same way as the shelves described above—i.e. as conventional shelf brackets attach to conventional upright standards.

Columns of shelves, such as shelves 302–304 described above, can be secured to the columns 371–373 formed by the uprights 330 adjacent to the cabinets 349, 353 and workstation 352. To complete the system, a base cover (not shown in FIGS. 18 and 19) can be secured to base support members 347.

Thus, as can be readily appreciated, a wide variety of shelving systems with accompanying work areas can be created by the selective placement of uprights 330 and the selection of different work area fixtures. Of course, any number of different types of fixtures can be used in connection with the described shelving system to create work areas and stations in combination with shelving for display and storage to meet the needs of just about any foreseeable office, retail or other work environment.

As shown in FIG. 20, the same type of system described above as mounted to a wall can also be constructed as a freestanding unit much like a conventional gondola. Uprights 200 are secured to both ends of base 201 by conventional attachment means, as previously described. Horizontal tracks 202 are secured to uprights 200 and intermediate uprights 203 are secured at selected positions along the length of tracks 202. As described above and illustrated in FIGS. 20, 21 and 26, in a preferred embodiment uprights 202 are secured back-to-back along the length of horizontal tracks 202 to create a space 360 between the uprights in which a decorative panel can be sandwiched and held.

In one embodiment illustrated in FIG. 21, horizontal tracks 202 are provided with a series of spaced apertures 210 along the length of their top surfaces to receive intermediate uprights 203. Brackets 205 (FIG. 21) are secured (for example, by spot welding) to uprights 203 near the top and bottom ends of the uprights to secure the uprights to tracks 202. Brackets 205 are similar in structure to brackets 331 described above and each includes a downwardly projecting tab to fit into and engage a selected aperture 210 in the upper and lower tracks 202. (In an alternative embodiment shown in FIGS. 20 and 26, uprights 200 and 203 may be welded to horizontal tracks 202 at desired locations.) Again, as shown in FIGS. 20 and 21, uprights 200 and 203 include a series of spaced apertures 204 along their front surfaces to receive and support fixtures such as shelves and workstation components as described above in connection with the wall-mounted system depicted in FIGS. 2B and 19. As with the wall-mounted system, a variety of fixture configurations can be constructed in the form of a freestanding gondola by the selective placement of the uprights along horizontal tracks 200.

Horizontal intermediate tracks 211 such as those shown in FIGS. 19, 20, 22, 23 and 26 can be added to both a wall-mounted or freestanding gondola system between uprights to provide additional flexibility in configuring shelving and workstation components. As described below, mounting an intermediate track 211 between a pair of adjacent uprights provides additional locations along the length of the intermediate track at which further uprights can be selectively mounted. In turn, these additional uprights provide additional mounting locations for shelves and workstation components.

Ends 420 of intermediate tracks 211 can be mounted to adjacent uprights in any suitable manner. For example, in the embodiment shown in FIG. 23, a plate 425 is associated with track end 420 and plate 425 is keyhole pinned or bolted to the inner surface 430 of upright 200 using a mounting keyhole pin or bolt 435 in a conventional manner.

Figure 23:
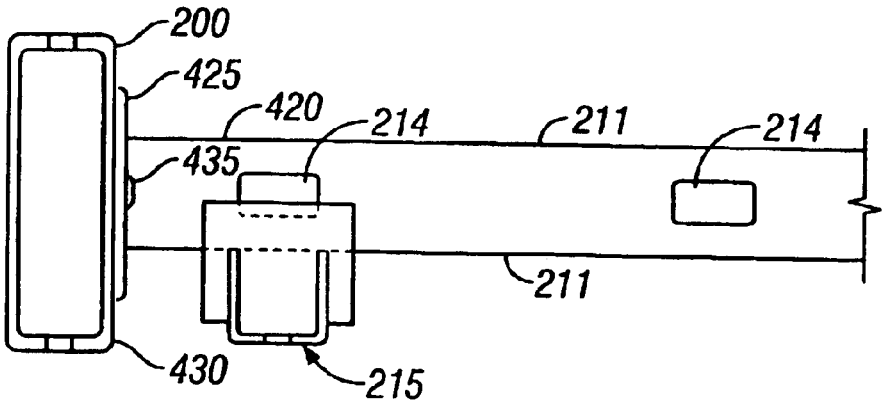
FIG. 23 is a partial top plan view of the assembly of FIG. 22.

In this embodiment, track 211 (like full-size tracks 325 and 202) includes a series of spaced apertures 214 along its top surface (FIG. 22) to receive and secure uprights 215. Uprights 215 include brackets 217 like those described above (such as brackets 331 and 203) to fit into and engage apertures 214. As best seen in FIG. 23, the depth of upright 215 is less than that of upright 200—upright 215 is dimensioned so that its front surface is flush with the front surface of upright 200 when upright 215 is secured to track 211. This arrangement thus presents a system in which the front faces of all the uprights are flush with one another so that shelving or other components can be secured in a unified system, wherein the original uprights 200 may still be used to receive and support shelves and other fixtures.

The bottom of upright 215 can be secured to the system in any suitable manner. In the embodiment shown in FIG. 20, a peg 442 extends from the bottom of upright 215 and bottom track 202 features a series of apertures 443 sized and shaped to receive and securably hold peg 442.

In an alternative embodiment shown in FIGS. 20 and 26, intermediate track 211 comprises two half tracks 440 which extend from opposite sides of the upright 215. The half tracks 440 can be mounted to the upright 215 in any suitable manner; for illustrative purposes, the half tracks shown in FIGS. 20 and 26 are welded to upright 215. In FIG. 20, the half tracks are welded near the top of the upright 215 to form a single T-shaped structure. In FIG. 26, a pair of half tracks 440 are welded near the top of upright 215 and another pair of half tracks 440 are welded near the bottom of upright 215 to form a single I-shaped structure. It should be understood, however, that these locations are shown for illustrative purposes only, and that the half tracks can be mounted anywhere along the length of upright 215. Likewise, the length of intermediate track 211 can also vary. For example, although the upright 215 in FIG. 26 is approximately the same length as uprights 203, a shorter upright 215 can also be used, thereby allowing the intermediate track to be mounted between uprights 203 at different selected heights.

In the embodiments shown in FIGS. 20 and 26, intermediate track 211 is mounted to uprights 203 by tabs 218 extending outward from either end 420 of the track to engage one of the spaced series of apertures 220 provided on the forward-facing surfaces of uprights 200 and/or 203. Tracks 211 may thus be arranged at varying heights to support uprights 215, which, although not necessary, may vary in length if desired to accommodate the vertical placement of tracks 211.

It should be noted that in this embodiment, when track 211 is secured between a pair of uprights, the front faces of upright 215 will lie in the same plane as the front faces of the uprights which support tracks 211, as depicted in FIG. 20. This arrangement thus presents a system in which the front faces of all the uprights are flush with one another so that shelving or other components can be secured in a unified system.

In an alternative embodiment shown in FIG. 19, the top of upright 215 is welded to the bottom surface of the intermediate track 211 to forma single "T-shaped" unit 225, which is supported between the uprights 200 and 203. Unit 225 provides many of the same advantages as tracks 211 used in combination with uprights 215.

Figure 24:
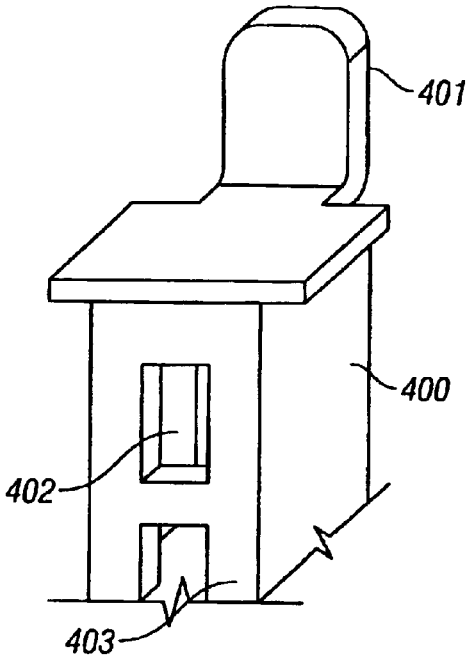
FIG. 24 is a partial view of a standard for use in accordance with the present invention.
Figure 25:
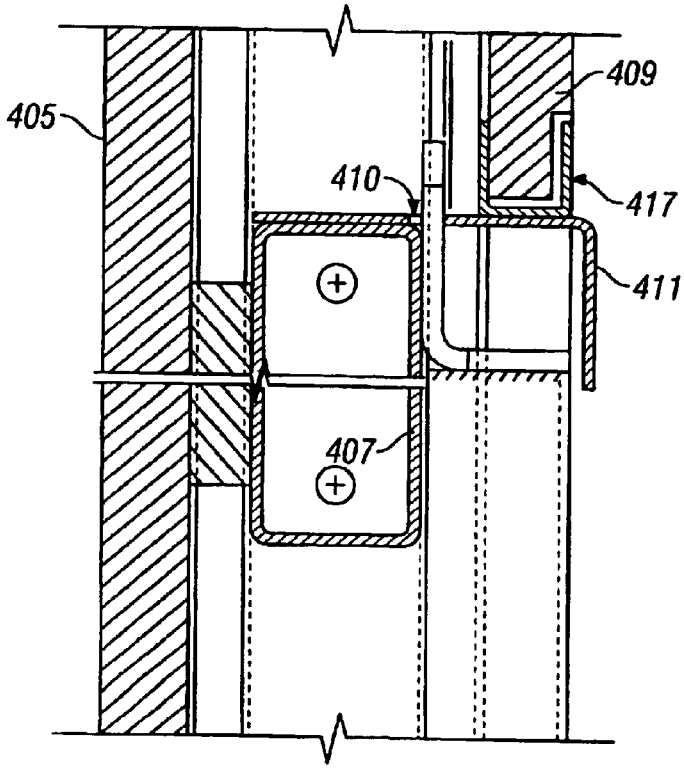
FIG. 25 is a partial side view of a wall system featuring the standard of FIG. 24.

In yet another embodiment particularly suitable for use with modular rooms and wall systems, standard 400 shown in FIG. 24 includes an upwardly extending tab 401 secured to the top of the standard and a series of spaced apertures 402 running along the front face 403 of the standard. A typical wall system in connection with which the standard 400 is intended for use is shown in FIG. 25, where the outer wall comprises an exterior panel 405, interior horizontal elongated support members 407 and interior panel 409. An elongated L-shaped member 411 is secured (such as by spot welding) to the top of support 407 and includes a series of spaced apertures 410 for receiving vertical standards 400, as will be described below. A U-shaped retainer channel 417 is welded to the top surface of member 407 with the channel opening upwardly. As can be seen in FIG. 25, retainer 417 is provided to support interior panel 409. In a preferred embodiment, support 407 is formed from a hollow metal tube measuring 1"×2¾".

Apertures 410 are sized and shaped to receive tabs 401 on standards 400 to removably secure the standards at desired locations along the wall. In a preferred embodiment, the apertures are spaced four inches off center, providing a relatively large number of locations along the wall at which standards 400 can be placed. As a result, standards 400 can be configured as needed to create a wide variety of shelving systems.

When standard 400 is secured in aperture 410, the front portion of L-shaped member 411 extends downward as a screen to hide the mounting tab 401 from view in order to create a streamlined appearance in which the standard appears to be an integral structural component of the wall.

In one embodiment, the bottom of standard 400 is an inverted version of the top, having a downwardly extending tab instead of an upwardly extending tab. Accordingly, the bottom wall mounting structure is also an inverted version of the one described above and features an L-shaped member having a front portion that extends upwardly and an aperture for receiving the bottom tab. Alternatively, the bottom of standard 400 can be mounted using any of the methods and structures described above in connection with upright 215.

Once standards 400 are placed at selected locations along the wall, shelves and other workstation components as described above can be secured in various columns and configurations by means of the series of apertures 402 running down the face of the standards. This particular embodiment thus provides a means to create a highly adjustable shelving system as an integral part of a modular wall construction. With this embodiment, there is no need to construct a separate freestanding gondola or to bother securing the system to the surface of a wall by unsightly or cumbersome fasteners. The means by which the vertical support standards are secured in place are included as an integral part of the wall itself, contributing to a unified appearance for the entire system.

There has been described herein a shelving/display system capable of supporting and displaying different sizes and types of items on a single gondola or wall system, making it possible to create varying visually pleasing configurations in a manner that is free of the shortcomings of the prior art. It will be apparent to those skilled in the art that modifications may be made in the system without the departing from the spirit and scope of the invention. Accordingly, it is not intended that the invention be limited except as it may be necessary in view of the claims.

What is claimed is:

1. A shelving/display system for use as a component of a wall, the system comprising:

generally horizontal top and bottom tracks secured within the wall, each track having a top surface;

an elongate member fixedly secured to the top surface of each track, a portion of the elongate member extending away from the track and a series of apertures spaced along the portion of the elongate member, the apertures accessible from the exterior of the wall; and generally vertical support/display members adapted for attachment in the apertures in the elongate members, each support/display member having a front surface and a series of apertures spaced along the surface.

2. The shelving/display system of claim 1 further comprising a screen portion extending downwardly from the elongate member portion that extends away from the track.

3. The shelving/display system of claim 1 further comprising a tab located on and extending outwardly from each end of the support/display members, the tabs adapted to removably engage the apertures in the elongate members to removably secure the support/display members to the elongate members.

4. The shelving/display system of claim 1 wherein the wall has an interior surface and the front surfaces of the support/display members lie in the same vertical plane as the interior surface of the wall.

5. A shelving/display system comprising:

generally horizontal top and bottom tracks secured in a spaced-apart relationship, each track having a front surface and a series of apertures spaced along the front surface;

at least two generally vertical support/display members adapted for engagement in the track apertures;

a pair of brackets associated with the at least two support/display members, each bracket adapted to removably engage the track apertures to removably secure the support/display members to the tracks; and an intermediate horizontal track extending between and secured to two adjacent support/display members of the at least two generally vertical support/display members, the intermediate track having a top surface and a series of apertures spaced along the top surface;

wherein the at least two support/display members have a front surface and a series of apertures along the front surface.

6. The shelving/display system of claim 5 wherein the top and bottom tracks are adapted to be secured to a wall.

7. The shelving/display system of claim 5 wherein there are a plurality of support/display members are secured to the tracks in a series of columns and a plurality of fixtures are removably received in the apertures in the front surfaces of the support/display members to form at least one column of fixtures.

8. The shelving/display system of claim 5 wherein the intermediate track is adapted to be removably secured to the support/display members at selected vertical locations on the support/display members.

9. The shelving/display system of claim 5 further comprising an intermediate upright adapted to be secured to the intermediate track in the intermediate track apertures, the intermediate upright having a front surface and a series of apertures along the front surface.

10. The shelving/display system of claim 9 wherein the front surface of the intermediate upright lies in the same vertical plane as the front surfaces of the two support/display members to which the intermediate track is secured.

11. The shelving/display system of claim 5 wherein there are at least two adjacent support/display members and further comprising an intermediate horizontal track and an intermediate upright depending from the intermediate track, the intermediate track and upright formed as an integral unit extending between and secured to the two support/display members.

12. The shelving/display system of claim 5 further comprising at least one generally horizontal base having at least two upstanding base posts wherein the top and bottom tracks are adapted to be secured to the posts.

13. A shelving/display system comprising:

generally horizontal top and bottom tracks secured in a spaced-apart relationship, each track having a front surface and a rear surface;

a first generally vertical support/display member secured to the tracks adjacent the front surfaces of the tracks;

a second generally vertical support/display member secured to the tracks adjacent the rear surfaces of the tracks and opposite the first member;

wherein each member has a surface directed outwardly from the tracks and defining a series of spaced apertures.

14. The shelving/display system of claim 13 wherein the top track has a top surface and a series of apertures spaced along the top surface and further comprising a bracket associated with the first support and a bracket associated with the second support, the brackets adapted to removable engage the top track apertures on the top surface of the top track.

15. The shelving/display system of claim 13 further comprising a panel and wherein the first member and the second member define a space for receiving a portion of the panel.

16. The shelving/display system of claim 15 wherein the panel has a top edge and the top track has a groove for receiving the top edge of the panel.

* * * * *